United States Patent [19]

Hara et al.

[11] Patent Number: 4,967,679

[45] Date of Patent: Nov. 6, 1990

[54] AUTOMATIC THREAD TENSION CONTROL SEWING MACHINE

[75] Inventors: Kazumasa Hara; Mikio Koike, both of Tokyo; Mitsuru Nishijima, Kyobashi, all of Japan

[73] Assignee: Janome Sewing Machine Co. Ltd., Tokyo, Japan

[21] Appl. No.: 347,336

[22] Filed: May 3, 1989

[30] Foreign Application Priority Data

May 27, 1988 [JP] Japan ..... 63-128191

[51] Int. Cl.[5] ..... D05B 3/02; D05B 47/04

[52] U.S. Cl. ..... 112/453; 112/255; 112/302

[58] Field of Search ..... 112/453, 302, 254, 255, 112/456

[56] References Cited

U.S. PATENT DOCUMENTS 4,649,844 3/1987 Matsubara ..... 112/302
4,702,185 10/1987 Hanyu et al. ..... 112/453 X

FOREIGN PATENT DOCUMENTS 60-25151 6/1985 Japan ..... 112/302

*Primary Examiner*—Peter Nerbun
*Attorney, Agent, or Firm*—Michael J. Striker

[57] ABSTRACT

An automatic thread tension control sewing machine comprising thread tension controller for clamping an upper thread with a predetermined pressure to control an amount of the upper thread supplied to a needle and a loop taker, thread tension setting means that determines a pressure with which the thread tension controller clamps the upper thread, upper thread supplying mechanism, a releasing mechanism controlling operation of the upper thread supplying mechanism, and a central processing unit for actuating the releasing mechanism in accordance with a selected stitch pattern.

2 Claims, 8 Drawing Sheets

AUTOMATIC THREAD TENSION CONTROL SEWING MACHINE

FIELD OF THE INVENTION

The present invention relates to an automatic thread tension control sewing machine, and more particularly, to a sewing machine in which the tension of an upper thread is controlled in response to a necessary amount of the upper thread for forming stitches.

BACKGROUND OF THE INVENTION

With respect to sewing machines which form lock stitches, there have been made proposals for setting concatenating or crossing points of an upper thread and a lower thread in the thickness of a fabric to be sewn by adjusting the tension or the supplying amount of the upper thread.

The stitches to be formed in the fabric generally include straight stitches and various types of zizag stitches, the former being produced by a vertically reciprocating needle while the fabric is transported relative to the needle, and the latter being formed by adding thereto lateral movements of the needle. The upper thread tension and the amount of the supplied upper thread is adjusted in response to the required amount of the upper thread in these types of stitches.

The straight stitches and the zigzag stitches are generally required to have different positions of proper crossing points of the upper and lower threads within the thickness of the fabric. The former is required to have the crossing point set at about the center in the fabric thickness. The allowance is that the crossing point does not appear on the upper surface or the rear surface of the fabric. The thinner is the fabric, the narrower is the allowance, and the more exact adjustment is required, accordingly. Since the required amount of the upper thread is determined by the feeding amount and the thickness of the fabric, it does not vary per each stitching.

The zizag stitches are generally required to have the crossing points set at the rear surface of the fabric. Because if the crossing point is set at the center of the fabric, the lower thread is seen from the upper surface of the fabric through needle perforations of the fabric, and if the both threads have different colors, the lower thread must be prevented from mixing into patterns formed with the upper thread only.

Therefore, the crossing point is set at the rear side of the fabric, and the lower thread is to extend within a range of $\frac{1}{4}$ to $\frac{3}{4}$ of a set zigzag width as shown in FIG. 3. In order to cover the remaining range with the upper thread, adjustment of the upper thread tension and the supplying amount of the upper thread is required. The adjusting allowance is larger than that of the straight stitches. The zigzag stitch patterns will include stitches of different amplitude.

When adjusting the tension of the upper thread, a fine adjustment per each of stitches is difficult but it is possible to set the tension at a constant value.

On the other hand, when adjusting the supplying amount of the upper thread, the fine adjustment per each stitch is easy, but in this case, control data is required per each stitch, and a control device is therefore complicated.

SUMMARY OF THE INVENTION

Therefore, it is an object of the invention to provide an automatic thread tension control sewing machine which, in the straight stitching, adjusts the supplying amount in response to the requiring amount of the upper thread, and in the zigzag stitching, adjusts the tension of the upper thread.

The automatic thread tension control sewing machine according to the invention, comprises a thread tension control means for clamping the upper thread with a set pressure to control an amount of the upper thread to be supplied to the needle and the loop taker, the control means being operative to release the upper thread, and thread setting means manually operated in a first region for setting the thread tension control means to a first condition in which the thread tension control means is operative to clamp the upper thread with a predetermined pressure. The thread tension setting means manually operate in a second region to set the thread tension control means to a second condition in which the thread tension control means is selectively operated to clamp the upper thread with one of a plurality of predetermined pressures which differ from the pressure obtained in the first region.

Upper thread supplying means is provided between the thread source and the thread tension control means. The upper thread supplying means includes a main roller rotatable on a first shaft and a follower roller rotatably mounted on a second shaft. The follower roller disengagingly contacts the main roller to draw out the upper thread in cooperation with the main roller. The upper thread is guided between the main and follower rollers in a predetermined thread path. A drive is associated with fabric feeding means to rotate the main roller.

The automatic thread tension control sewing machine according to the invention comprises a releasing mechanism operable in one direction to disengage the follower roller from the main roller, and in an opposite direction, to move the follower roller into engagement with the main roller.

The releasing mechanism is controlled by a central processing unit (CPU) in accordance with selection of the straight stitch and setting of the thread tension setting means, to operate for a predetermined period of time for each reciprocation of the needle.

DETAILED DESCRIPTION OF THE PREFERRED EMBODIMENT

The invention will be explained in detail with reference to the attached drawings.

Figure 2:
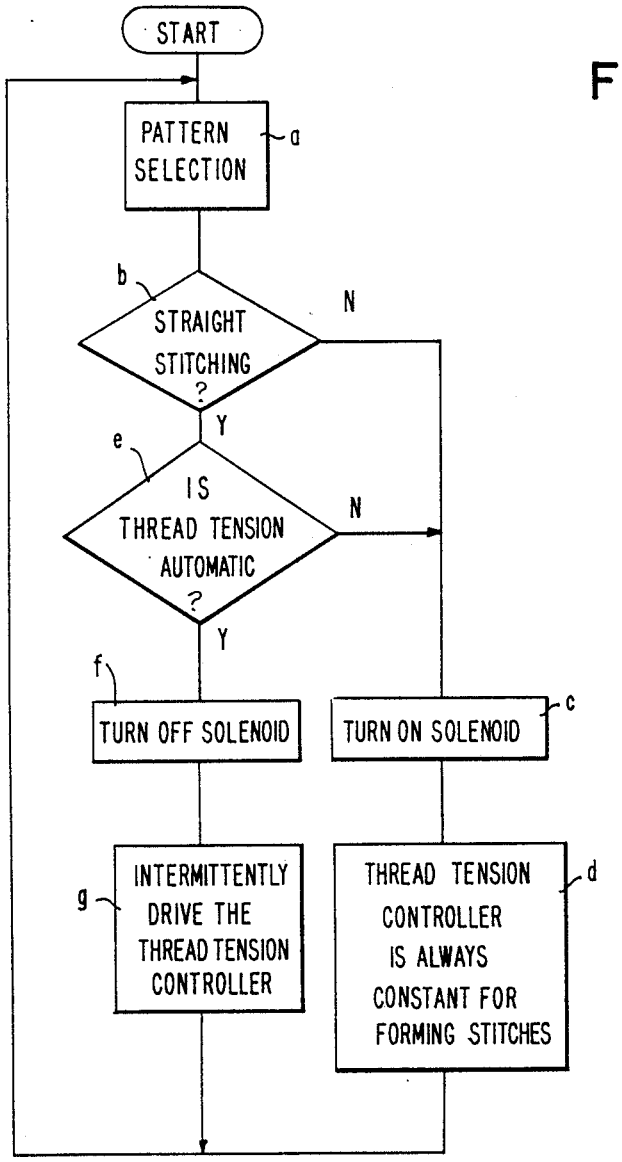
FIG. 2 is a flow chart thereof.
Figure 3:
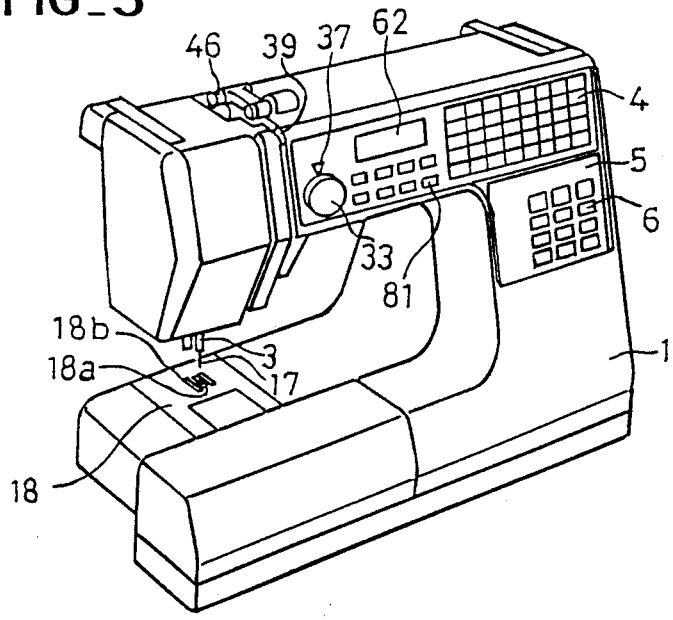
FIG. 3 is a perspective view of a sewing machine according to the invention.
Figure 4:
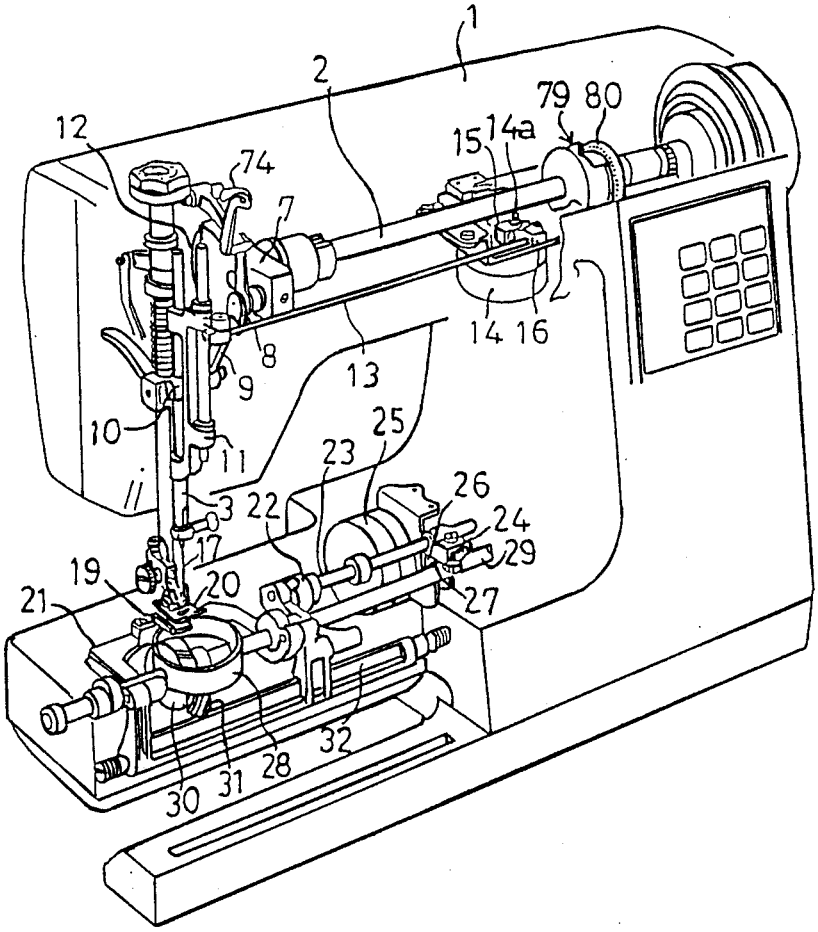
FIG. 4 is a view of the mechanism of the sewing machine incorporated with the device of the invention.

FIG. 3 shows the perspective view of the sewing machine of the invention, and an explanation will be made with reference to the mechanism of FIG. 4, too. A pattern selecting means 4 is attached to the operating side of a machine frame 1 for indicating patterns and relevant pattern numbers. A figure key 6 corresponding to FIGS. 0 to 9 on a panel 5 is operated to select a desired one from the pattern numbers, and the selected number is shown in pattern indicating means 62. The pattern may be directly shown by LCD. A pattern storing mean 81 stores patterns selected by the number key 6.

The machine frame 1 supports a vertically movable needle bar 3, connected to an upper rotatable shaft 2, and carrying a needle 17 at its end portion. As generally known, the needle bar 3 is slidably inserted into a needle bar supporter 11 and is fixedly connected to a needle holder 10 which is connected to a needle bar crank 8 through a crank rod 9.

The crank 8 is operatively connected to a balance weight 7 secured to one end of the upper shaft 2 for rotation therewith. The needle bar supporter 11 is pivotably mounted on a vertical shaft 12 secured to the machine frame 1, and is prevented from a vertical movement. The needle bar supporter 11 is connected to one end of a rod 13 which has the other end connected to an arm 15 secured on an output shaft 14*a* of a stepping motor 14 for controlling the needle position.

A needle plate 18 having a needle hole 18*a* is secured to the machine frame 1 at the lower portion of the needle bar 3.

A feed dog 19 is mounted on a feed arm 21 to be driven by the drive shaft 2. The movement of the feed arm 21 is adjusted by adjusting an angular position of a member 22 fixed to one end of an adjusting shaft 23 which has its other end secured to an arm 24 connected to a crank 26 mounted on the output shaft of a feed control stepping motor 25 by means of the crank 26 and a link 27.

A loop taker 28 serving as a needle thread catching means, is rotatably supported on the machine frame 1 under the needle plate 18. A gear 30 meshes with a gear 31, the former being secured on a lower shaft 29 to be rotated in synchronism with the needle bar 3 by the upper shaft 29 and the latter being secured integrally to the lower portion of the loop taker 28.

The reference numeral 79 designates detecting means of rotation phases of the upper shaft 2 (called as "upper shaft phase" hereafter). The detecting means comprises a disc 80 mounted on the upper shaft 2, and a photointerrupter (not shown) fixed to the machine frame 1. The details thereof are known and do not form part of the subject invention.

Figure 5:
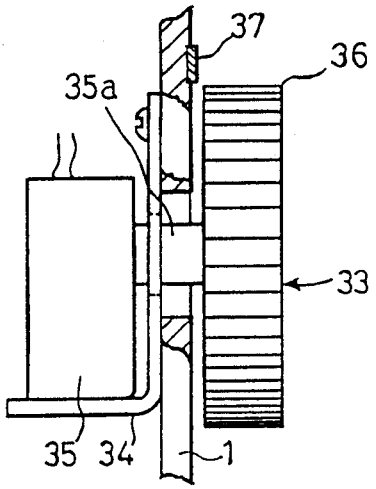
FIGS. 5 and 6 are views of a thread tension selecting means.
Figure 6:
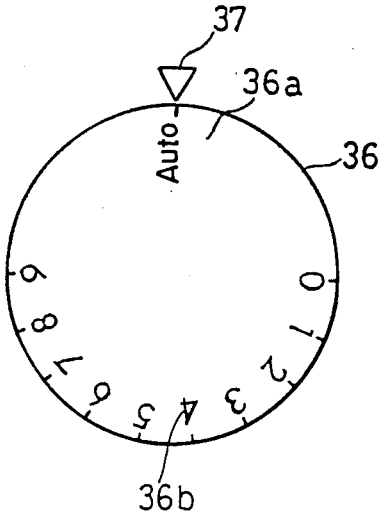

The reference numeral 33 in FIG. 3 designates a thread tension selecting means, and an explanation will be made with reference to FIGS. 5 and 6. A potentiometer 35 is secured to an attaching plate 34 supported on the machine frame 1, and has shaft 35*a* projecting outside of the sewing machine through a hole formed in the machine frame 1. A dial 36 is mounted on the shaft 35*a*, and shows on its face "AUTO" 36*a* for setting the thread tension to be automatic, and "0 to 9" 36*b* for setting it to be manual.

An indication mark 37 is seen on the front side of the machine frame 1 for agreeing to the operation dial 36.

Figure 7:
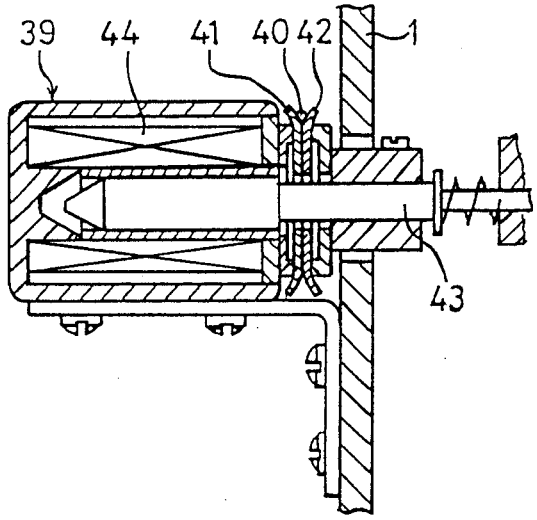
FIG. 7 is a view of an automatic thread tension controller of the invention.

The potentiometer 35 communicates with a central processing unit (CPU) 38 incorporated within the machine frame 1. The reference numeral 39 designates an electric thread tension controller, details of which are shown in FIG. 7 and are well known.

Figure 8:
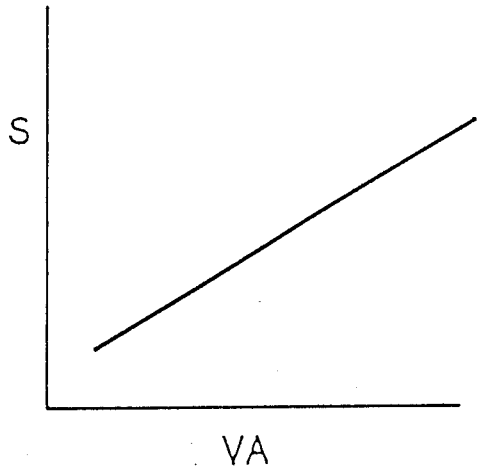
FIG. 8 is a graph for explaining the relation between the holding pressure (S) of a pair of thread tension discs and the amount of electric current (VA) in the electric thread tension controller of the invention.

The electric thread tension controller 39 holds an upper thread between a pair of thread tension discs 41 and 42, to either one of which a thread tension shaft 43 is pressed by actuation of an electromagnet 44. The amount (VA) of an electric current and the holding pressure (S) are in proportional relation as shown in FIG. 8.

Figure 1:
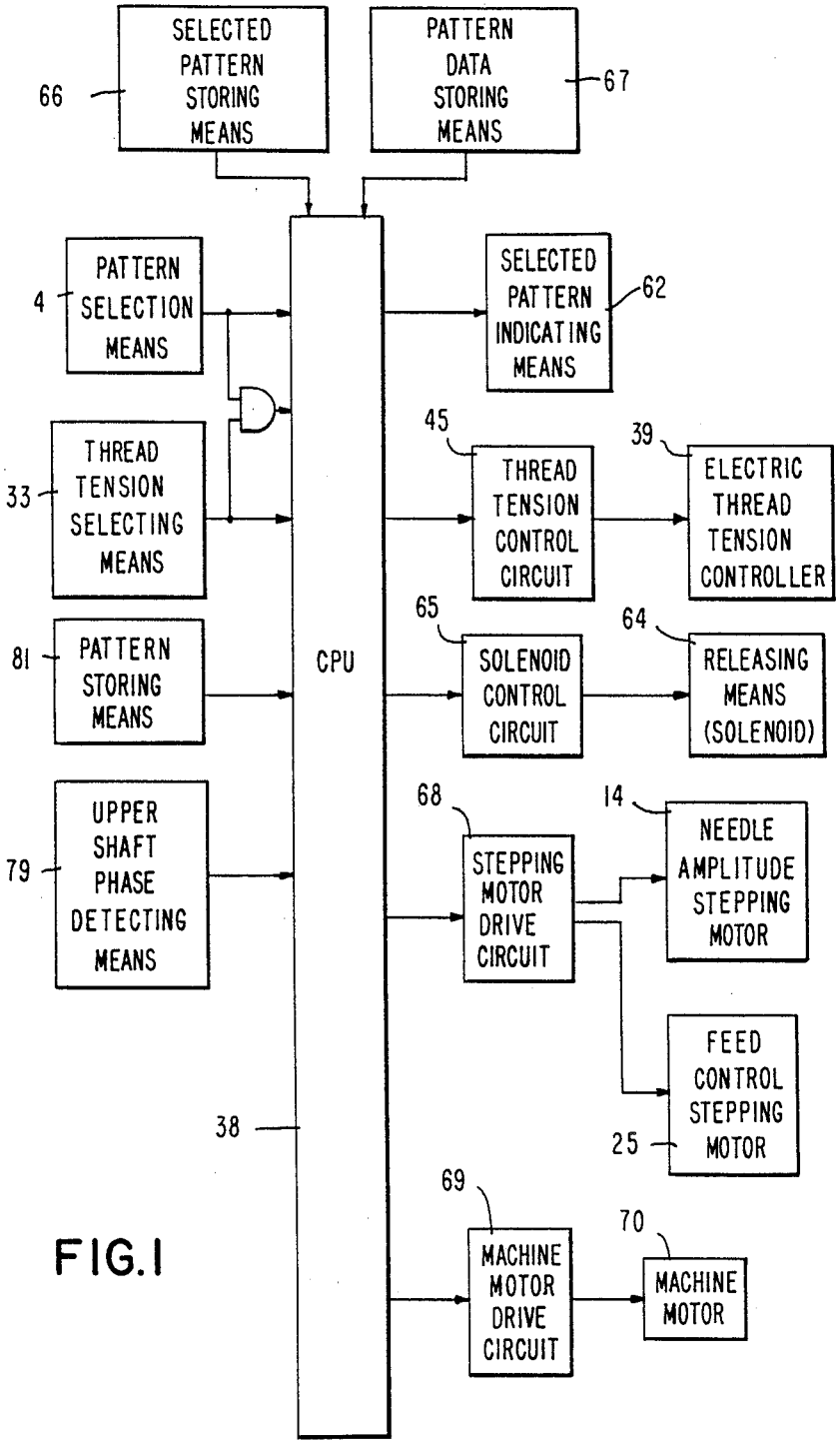
FIG. 1 is a control block diagram according to the present invention.

The electric thread tension controller 3 is connected to CPU 38 via a thread tension control circuit 45 as shown in the block diagram of FIG. 1. In FIG. 3, an upper thread supply device 46 will be explained in detail referring to FIGS. 9 and 10.

Figure 9:
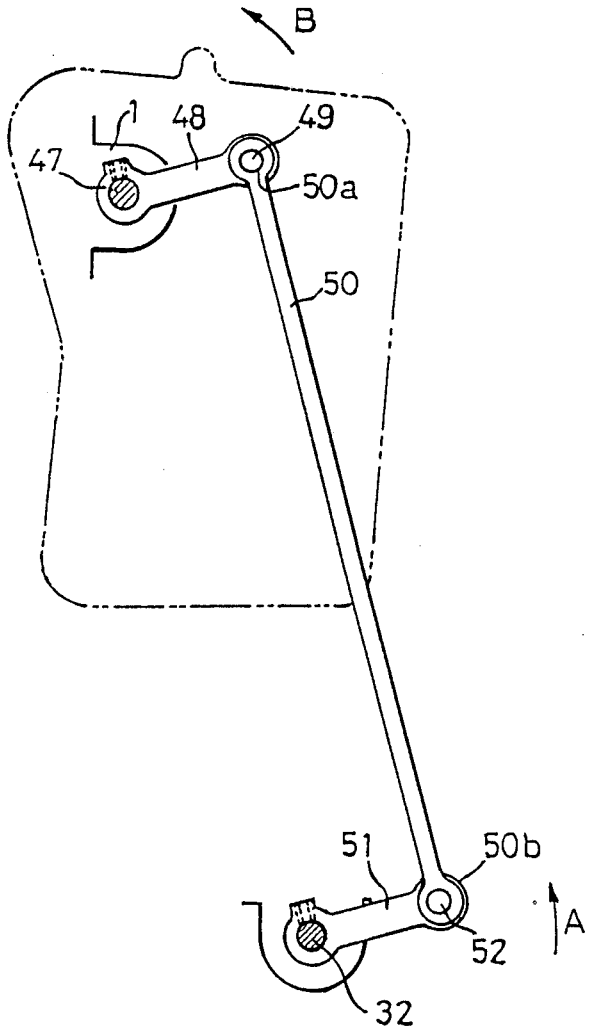
Figure 10:
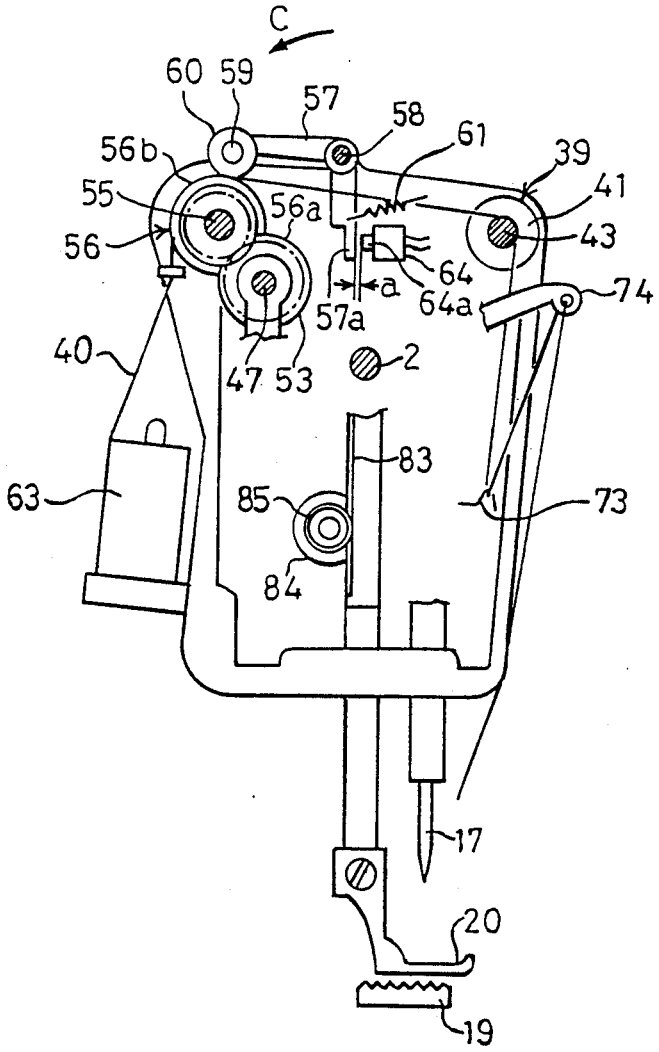

In FIG. 9 and FIG. 10, an upper feed shaft 47 is pivotably supported on the machine frame 1 and is rotatable parallel with the upper shaft 2. An arm 48 has an end secured to the upper feed shaft 47, and a pin 49 secured at the other end of the arm 48 passes through a hole 50*a* formed at one end of a rod 50.

The rod 50 has the other end formed with a hole 50*b* which is connected to one end of an arm 51 having its other end secured to a horizontal feed arm 32, so that rocking movement of the horizontal feed arm 32 may be transmitted to the upper feed shaft 47.

The horizontal feed arm 32 is, as it is generally known, operatively connected to the upper drive shaft 2 and is rocked in synchronism with rotation of the upper drive shaft, that is rotates in an direction of an arrow A, i.e., in a fabric forward feeding direction of the feed dog 19 to rock the upper feed shaft 47 in a direction of an arrow B. As the feed dog 19 returns to its upper position from its descending position under the needle plate, the feed arm 32 rocks in a direction opposite to that of the arrow A to rock the feed shaft 47 in a direction opposite to that of the arrow B.

An upper feeding mechanism is operable by rocking movement of the upper feed shaft 47 as it is known from U.S. Pat. No. 4,724,783.

In FIG. 10, a drive gear 53 is rotatably mounted on the upper feed shaft 47.

Figure 11:
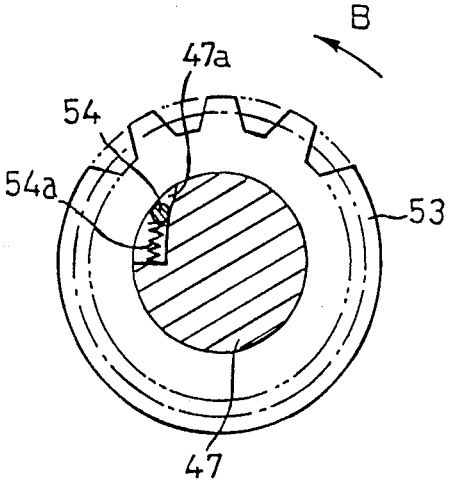
FIGS. 9 to 11 are views of an upper thread supplying device.
Figure 13:
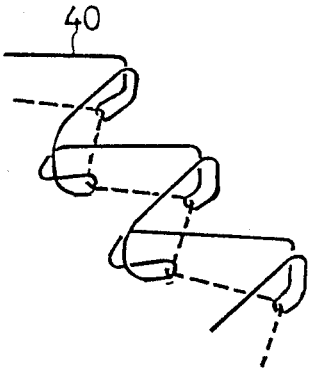
FIG. 13 is a view for explaining forming of zigzag stitches.

The upper feed shaft 47 is, as shown in FIG. 11, formed with a cutout 47*a* that provides, together with an inner periphery of the drive gear, a space 53 for accommodating therein a roller 54 and a spring 54*a*. The spring 54 normally biases the roller 54*a* against a face of the cutout 47 and the inner periphery of the gear 53 defining a wedge-shaped portion, so that the drive gear 53 is connected with the upper feed shaft 47 by the roller 54, and the drive gear may rotate in the direction B together with the shaft 47.

When the upper feed shaft 47 rotates in a direction opposite to that of the arrow B, the roller 54 moves from the wedge-shaped portion B to release the connection between the drive gear 53 and the upper feed shaft 47, and the upper feed shaft 47 only rotates in the opposite direction to that of the arrow B, and the drive gear 53 does not rotate on the upper feed shaft 47.

Thus, the drive gear 53 is designed to rotate in response to a component of the fabric forward feeding direction of the feed dog operated by the horizontal feed arm 32.

A roller shaft 55 is supported on the machine frame 1 in parallel with the upper feed shaft 47, and a thread supply roller 56 is rotatably mounted on the shaft and includes a gear 56a secured at one side thereof and meshing with the drive gear 53.

A lever 57 has an intermediate portion rotatably mounted on shaft 58 supported on the machine frame 1 in parallel with the roller shaft 55, and a follower roller 60 is rotatably mounted on a pin 59 secured at one end of the lever 57.

A spring 61 is expanded between another end 57a of the lever 57 and the machine frame 1 to normally turn the lever 57 in a direction of an arrow C so as to press the follower roller 60 against the thread supply roller 56.

The reference numeral 64 designates a solenoid secured to the machine frame 1 in opposition to the other end 57a of the lever 57 within the machine frame 1, which is, as shown in FIG. 1, connected to CPU 65 via a solenoid circuit 65 so that when the solenoid 64 is not supplied with the electric current, a clearance (a) remains between the end 57a and an output shaft 64a of the solenoid 64. When the solenoid 64 is energized, the output shaft 64a extends to push the end 57a, and rotates the lever 57 in a direction opposite to that of the arrow C against the action of the spring 61 to disengage the follower roller 60 from the thread supplying roller 56.

In FIG. 10, the reference numeral 63 designates an upper thread source, and an upper thread 40 therefrom is guided between the thread supply roller 56 and the follower roller 60 and between a pair of thread clamping discs 41 and 42 of the electric thread tension controller 39. The upper thread 40 from the controller 39 extends to a thread hook spring 73 supported on the machine frame 1 and is passed through a needle eye of the needle 17 by a thread take-up lever 74.

In FIG. 1, selected pattern storing means 66 is connected to CPU 38 for storing the patterns upon operation of the pattern storing means 81. A stepping motor drive circuit 68 is connected to CPU 38 for driving the needle amplitude stepping motor 14 and the feed control stepping motor 25.

Operation of the sewing machine according to the invention will be explained with reference to FIG. 1 and FIG. 2.

At a step (a) of FIG. 2, a pattern is selected by operating the figure key 6 of the pattern selecting means 4, and an indication data and a stitch data are read out from the pattern data storing means 67 and shown in the indicator 62.

The stitch data read out from a pattern data storing means, 67 is stored in a selected pattern storing means 66 by operating the memory key of a pattern storing means 81.

A machine motor 70 is driven to rotate the drive shaft 3.

At a step (b) of FIG. 2, it is discriminated whether the pattern selected by the pattern selecting means 4 is formed with a straight stitching or not.

If it is discriminated that the zigzag stitching rather than the straight stitching has been selected, the solenoid 64 is turned ON at a step (c). The output shaft 64a of the solenoid pushes out the roller arm 57 and rotates it at step (d) around the arm shaft 58 in a direction opposite to that of the arrow C, so that the follower roller 60 is set apart from the supply roller 56, and the upper thread 40 is not supplied.

The thread tension selecting means 33 causes the operation dial 36 to coincide with the indication mark 37. If "MANUAL" indication of the operation dial 36 is set against the indication mark 37, the output value of the potentiometer is changed, and the amount of the current is adjusted to the electric thread tension controller 39 in response to the output value to change the holding pressure of the pair of thread tension discs 41, 42. In a case of "AUTO", the output value is in response to this indication, and the amount of the electric current is suited to a predetermined automatic condition to generate a predetermined holding pressure.

A further explanation will be made to a case that the pattern selected at the step (b) by the pattern selection means 4 is straight, and "AUTO" is selected in a next step (e) by the thread tension selecting means 33. In this case, the solenoid 64 is turned OFF at a step (f) to stop the supply of the electric current, and the output shaft 64a of the solenoid is retracted as seen in FIG. 10 apart from the roller arm 57. The roller arm 57 is rotated in the arrow C by biasing of the spring 61 and the follower roller 60 contacts the roller part of the supply roller 56 and holds the upper thread 40.

Subsequently, the upper thread tension controller 39 is set to an intermittent mode. At a step (g), phases holding and releasing the upper thread 40 between the thread tension discs 41, 42 is alternate for supplying the upper thread in association with the supply means.

The intermittent action of the thread tension controller 39 will be explained with reference to FIG. 12.

Figure 12:
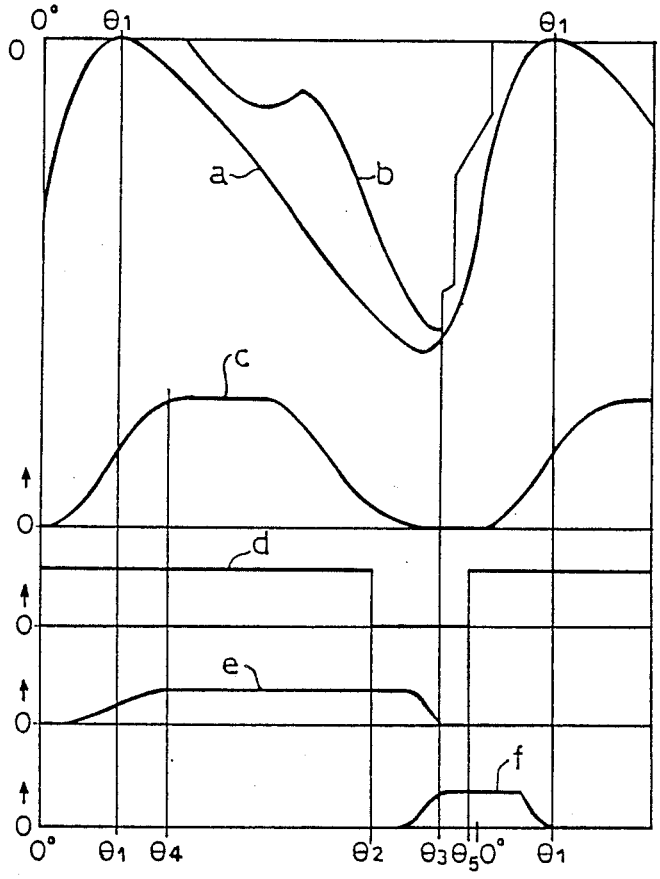
FIG. 12 is a graph for explaining control of thread tension.

In FIG. 12, a lateral bar shows rotation phases of the upper shaft where an upper dead phase is 0°, and a vertical bar shows displacements:

a is a curve of supplying the upper thread of a take-up lever 74, b is a curve of the amount of the upper thread to be drawn by the needle thread hook of the loop taker 28, c is a curve of a horizontal feed, d is a curve of the pressure of the upper thread tension controller 39, e is a curve of the supply of upper thread by the supply roller 56 and the follower roller 60, and f is a curve of slacking the supplied thread by releasing the upper thread controller.

With respect to the amount e of supply of upper thread by the roller, the supply roller 56 is driven in synchronism with the horizontal feed arm 32, and the upper thread 40 is supplied to between the phase 0° of the upper shaft and the phase $\theta_{4'}$ and since the upper thread tension controller 39 is set at the strong holding pressure of the pair of discs, the upper thread supplying amount remains as the slacking amount between the supply roller 56 and the upper thread tension controller 39.

At a phase $\theta_2$ the upper thread tension controller is actuated and releases the holding of the discs.

Before and after a phase $\theta_3$ where the necessary amount of the upper thread drawn by the loop taker 28 is a maximum, when the slacking amount of the upper thread as the difference between the amount a of the upper thread of the take-up lever 74 and the amount b of the upper thread to be drawn by the loop taker 28 decreases, a thread catching spring 73 serves as a buffer means, and the upper thread 40 stored in the thread catching spring 73 is supplied from the upper thread tension controller 39 into an upper thread path, and is consumed for tightening the thread at the upper dead point phase $\theta_1$ of the take-up lever 74. Therefore by the above stated actuations, the upper thread is supplied for forming the stitches in response to the feeding amount per one stitch.

A response to the fabric thickness will be mentioned. As is shown in FIG. 10, a presser bar 3 fixing a fabric presser 20 at its lower part is pivoted on the machine frame in the vertical directions. A rack 83 is in mesh with a gear 85. A fabric thickness detecting means is provided for detecting the thickness of the fabric held between the fabric presser 20 and the needle plate 18, and the holding pressure of the electric thread tension controller 39 is varied in response to the detected value so as to adjust the allowance of drawing out the thread at phases other than the supplying phase.

What is claimed is:

1. An automatic thread tension control sewing machine comprising a thread source; a laterally swingable needle for carrying an upper thread extended from said thread source through a predetermined thread path; a rotatable upper drive shaft for vertically reciprocating said needle; a loop taker carrying a lower thread and operatively connected to said upper drive shaft to rotate in synchronism with movement of said needle for catching the upper thread and forming stitches with the upper thread and the lower thread on a fabric in cooperation with said needle; a thread take-up lever operatively connected to said upper drive shaft to vertically reciprocate in synchronism with the movement of said needle and said loop taker for supplying the upper thread to said needle and said loop taker upon downward movement of said take-up lever and for tightening a stitch upon upward movement of said thread take-up lever; fabric feeding means operatively connected to said upper drive shaft to operate in synchronism with the movement of said needle and said loop taker to feed a fabric with respect to said vertically reciprocating needle; memory means for storing stitch control data for a plurality of different stitch patterns including various zigzag stitch patterns and a straight stitch pattern; pattern selecting means including a plurality of keys operated to select a pattern to be stitched from said memory means;

thread tension control means for clamping the upper thread with a set pressure in one mode of operation to control an amount of the upper thread to be supplied to said needle and said loop taker, said thread tension control means being inoperative to release the upper thread in this mode of operation;

thread tension setting means manually operable in a first region to set said thread tension control means to a first condition in which said thread tension control means is operative to clamp the upper thread with a predetermined pressure, and in a second region to set said thread tension control means to a second condition in which said thread tension control means is selectively operative to clamp the upper thread with one of plural predetermined pressures which are different from the pressure obtained in said first region;

upper thread supplying means located between said thread source and said thread tension control means and including a main roller rotatably mounted on a first shaft and a follower roller rotatably mounted on a second shaft, said follower roller engaging said main roller to draw out the upper thread in cooperation with said main roller, said upper thread being guided between said main and follower rollers in the predetermined thread path;

drive means operably in association with said fabric feeding means to rotate said main roller;

releasing means operable in a first direction to disengage said follower and main rollers and operable in a second direction to provide for engagement of said follower roller with said main roller; and control means for actuating said releasing means for a predetermined period of time with each vertical reciprocation of said needle in response to selection of a v straight stitch and to operation of said thread tension setting means in the first region.

2. An automatic thread tension control sewing machine as set forth in claim 1, wherein said control means actuates said releasing means for disengagement of said follower and main rollers in response to selection of a zigzag stitch pattern.

* * * * *